US008118200B2

(12) United States Patent
Hickle et al.

(10) Patent No.: US 8,118,200 B2
(45) Date of Patent: Feb. 21, 2012

(54) DEVICE FOR REMOVING WRINKLES FROM THE SLEEVE OF A GARMENT

(75) Inventors: Ernest J. Hickle, New Market, TN (US); Joe Brogan, Dandridge, TN (US); Kevin W. Cliff, New Market, TN (US)

(73) Assignee: Forenta, Morristown, TN (US)

( * ) Notice: Subject to any disclaimer, the term of this patent is extended or adjusted under 35 U.S.C. 154(b) by 342 days.

(21) Appl. No.: 12/419,820

(22) Filed: Apr. 7, 2009

(65) Prior Publication Data

US 2010/0251581 A1 Oct. 7, 2010

(51) Int. Cl.
*D06F 71/28* (2006.01)
*D06F 71/00* (2006.01)

(52) U.S. Cl. ..... 223/74

(58) Field of Classification Search ..... 38/3, 14–16, 38/1 A; 223/67–74
See application file for complete search history.

(56) References Cited

U.S. PATENT DOCUMENTS

| | | | | |
|---|---|---|---|---|
| 2,479,729 | A | 1/1948 | Davis | |
| 2,759,644 | A | 9/1953 | Forse et al. | |
| 2,685,990 | A * | 8/1954 | Glover, Jr. | 223/73 |
| 2,760,698 | A * | 8/1956 | Maxwell et al. | 223/73 |
| 3,051,359 | A * | 8/1962 | Gayring | 223/73 |
| 3,297,216 | A * | 1/1967 | Radford | 223/73 |
| 3,471,067 | A | 10/1969 | Stewart | |
| 4,199,088 | A * | 4/1980 | Sanko | 223/67 |
| 5,148,955 | A | 9/1992 | Cares | |
| 5,359,792 | A | 11/1994 | Hanada et al. | |
| 5,458,265 | A * | 10/1995 | Hester et al. | 223/72 |
| 5,732,859 | A | 3/1998 | LeBlanc | |
| 5,819,446 | A * | 10/1998 | Pearl et al. | 38/66 |
| 6,119,379 | A | 9/2000 | Hickle et al. | |
| 6,237,261 | B1 | 5/2001 | Hickle et al. | |
| 6,662,980 | B1 | 12/2003 | Hickle et al. | |
| 6,725,585 | B2 | 4/2004 | Hickle et al. | |
| 6,868,995 | B2 | 3/2005 | Hickle et al. | |
| 2003/0226294 | A1 | 12/2003 | Hickle et al. | |
| 2003/0226863 | A1 | 12/2003 | Hickle et al. | |
| 2003/0226864 | A1 | 12/2003 | Hickle et al. | |

FOREIGN PATENT DOCUMENTS

GB 2068021 * 1/1980

OTHER PUBLICATIONS

Miscellaneous Advertisements for Prior Art Devices, Nov. 1995.

* cited by examiner

*Primary Examiner* — Ismael Izaguirre
(74) *Attorney, Agent, or Firm* — Pitts & Lake, P.C.

(57) ABSTRACT

A device for removing the wrinkles from the sleeve of a garment. A working surface defines a plurality of openings. Each of first and second sleeve holders are secured proximate an opening at a proximal end of each sleeve holder. First and second air bags are each configured to substantially surround a cooperating sleeve holder. Each sleeve holder and cooperating air bag is adapted to be received within a sleeve of the garment to extend the sleeve from the working surface. In one embodiment, a steam transfer device is configured to selectively transfer steam into each air bag and outwardly through each air bag to an interior surface of the sleeve. In another embodiment, a heated air transfer device is configured to selectively transfer heated air into each air bag and outwardly through each air bag to an interior surface of the sleeve.

18 Claims, 7 Drawing Sheets

DEVICE FOR REMOVING WRINKLES FROM THE SLEEVE OF A GARMENT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to a device for removing wrinkles from garments. More particularly, this invention pertains to a sleeve tensioning wrinkle remover for garments.

2. Description of the Related Art

Numerous machines have been provided for the purpose of steaming, ironing, and pressing garments after washing operations. Each prior device typically is configured to allow an article of clothing to be positioned on at least one supporting member such as a vertically oriented buck, which is moved against a pressing surface for the application of pressure from steam heated surfaces, and/or hot air to remove wrinkles from the article of clothing. Typically, a shirt, coat, or a pair of pants is positioned on a surface of a buck for a series of sequential pressing operations. Conventional devices are limited in that the series of sequential pressing operations requires positioning and, if necessary, repositioning of the article of clothing by the operator, and further requires a multitude of operating steps before the pressing of the article of clothing is completed. Further, after completion of the operating steps, touch-up ironing by an operator may be required to provide adequate removal of wrinkles along the seams of the garment, such as along a shoulder seam and/or a back of a shirt. Prior art devices related to pressing garments such as shirts and blouses are disclosed in U.S. Pat. No. 6,868,995, issued to Hickle et al. on Mar. 22, 2005; U.S. Pat. No. 3,471,067, issued to Stewart on Oct. 7, 1969; and U.S. Pat. No. 5,732,859, issued to LeBlanc on Mar. 31, 1998.

Considering the limitations of the prior art, a low-cost device for completing a series of coordinated operations including positioning, extending, steaming, and drying an article of clothing for removing wrinkles with minimal positioning of the article of clothing by an operator and minimal touch-up ironing by an operator is needed.

BRIEF SUMMARY OF THE INVENTION

According to one embodiment of the present invention, there is provided a device for removing wrinkles from the sleeve of a garment for tensioning, steaming, heating, and drying a sleeve of a garment to remove wrinkles of the garment during expanding, steaming and drying operations. The device for removing wrinkles from the sleeve of a garment includes a cabinet and a support frame that collectively form a base for support of the device above a supporting surface such as a floor. A front portion of the cabinet defines a generally horizontal working surface 24. The working surface defines a first opening and a second opening. The working surface includes mounting apparatus for mounting at least one sleeve proximate the first and second openings. In one embodiment, a first sleeve holder having a base end and a distal end is attached to the working surface proximate the first opening at the first sleeve holder base end. A second sleeve holder having a base end and a distal end is attached to the working surface proximate the second opening at the second sleeve holder base end in substantially parallel and spaced apart orientation proximate the first sleeve holder.

A first elongated air bag is positioned to extend along the length of the first sleeve holder and to substantially surround the first sleeve holder. A second elongated air bag is positioned to extend along the length of the second sleeve holder and to substantially surround the second sleeve holder. Each sleeve holder and cooperating air bag is sized to accept thereon each respective sleeve of a garment. At least a portion of each air bag is permeable to at least one of moisture, air, and steam. The device for removing wrinkles from the sleeve of a garment includes apparatus for delivering steam, heated air, or a combination thereof through the openings in the working surface and into and through the air bags. In one embodiment, the cabinet houses a steam reservoir which is connected to a steam transfer apparatus for directing steam to the interior of the steam reservoir. A steam coil is provided in fluid communication with the steam reservoir such that, as the steam reservoir is filled with steam supplied by the steam transfer mechanism, excess steam is directed into and through the steam coil. An output of the steam reservoir is connected to a plurality of steam outlets with a valve interposed therebetween. The steam outlets are disposed proximate the openings in the working surface such that, by selective actuation of the valve, steam is selectively blown from the steam reservoir through the openings in the working surface into the air bags.

An air transfer device is disposed within the cabinet and is configured to move air over the steam coil into the forward portion of the cabinet and to direct the heated air through the openings in the working surface. The steam coil is configured to transfer heat from steam moving within the steam coil to the air moved over the steam coil by the air transfer device. In one embodiment, the cabinet defines an air intake manifold configured to allow air from outside the cabinet to enter the cabinet and be accelerated by the air transfer device. In more discreet embodiments, an air filter is disposed within the air intake manifold and is configured to filter at least some impurities from air entering the cabinet.

In the illustrated embodiment, a tensioning arm is provided for biasing the yoke portion of the garment toward the working surface, thereby tensioning the shoulder seams. The tensioning arm includes a substantially elongated member having a proximal end secured proximate the cabinet by a rotatable connection. A contacting surface is disposed proximate a distal end of the elongated member. The rotatable connection is configured to allow the elongated member to rotate from a disengaged position wherein the contacting surface is removed from the garment, toward an engaged position to allow the contacting surface to engage the garment and bias the yoke toward the working surface, thereby applying tension to the yoke and the shoulder seams.

Another embodiment provides a heat transfer device such as an electric heat generator disposed within the cabinet absent a steam coil and steam reservoir. In this embodiment, the air transfer device is configured to move air through the heat transfer device, thereby heating the air, and to direct the heated air through the openings in the working surface and into and through the air bags.

In one embodiment of a method of operation for the device, a step of mounting includes placing a sleeve of a garment on each of at least two sleeve holders with each sleeve having a seam positioned proximate a working surface spaced between the sleeve holders. A step of raising includes raising each sleeve to an extended position above the working surface. A step of tensioning includes positioning a tensioning arm to an engaged position toward a yoke of the garment to engage and bias a yoke of the garment toward the working surface, thereby applying tension to the yoke and each seam. A step of expanding includes directing vapor into at least one air bag positioned within each sleeve to at least partially inflate the at least one air bag, thereby expanding the respective sleeve to an expanded configuration. A step of heating includes directing heated air into and through the at least one air bag to apply heated air to an interior surface of the respective sleeve, thereby heating and at least partially drying the sleeve. A step of deflating includes allowing the at least one expanded air bag of the expanding step to at least partially deflate. A step of retracting includes moving the tensioning arm from the engaged position.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
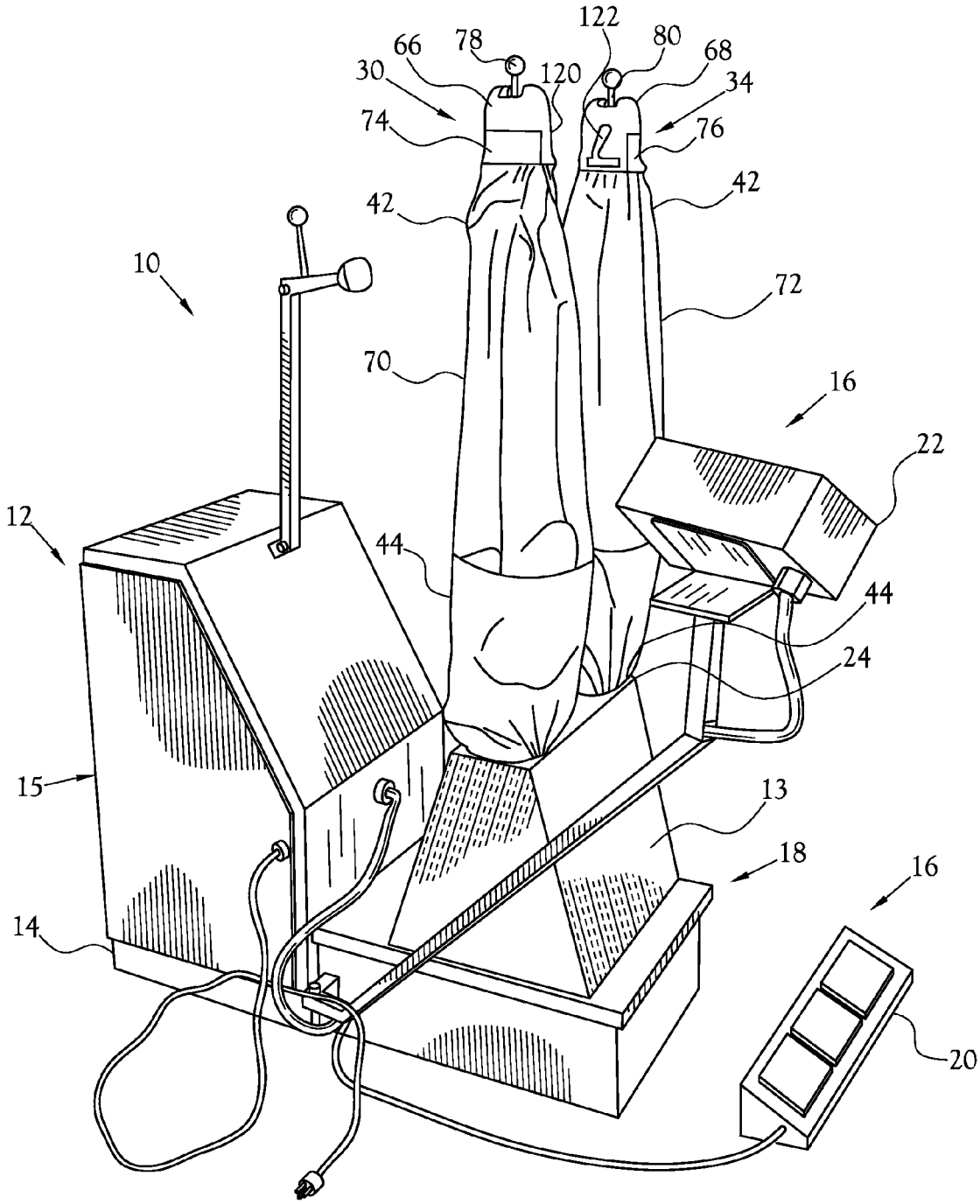
FIG. 1 is a perspective view of a one embodiment of a device for removing wrinkles from the sleeve of a garment of the present invention.

A device for removing wrinkles from the sleeve of a garment is disclosed for tensioning, steaming, heating, and drying a sleeve of a garment to remove wrinkles from the garment. A device for removing wrinkles from the sleeve of a garment, or device, is illustrated generally at 10 in the Figures and includes a cabinet 12 and a support frame 14 that collectively form a base for support of the device above a supporting surface such as a floor. The cabinet 12 includes a front portion 18 and rear portion 15. Referring to FIG. 1, the front portion 18 of the cabinet 12 defines a generally horizontal working surface 24. Multiple controls 16 are generally positioned on, or above, the front portion 18 of the cabinet 12. For example, in the illustrated embodiment foot pedals 20 are provided forward of the front portion 18 of the cabinet 12 to allow for control measures for an operator of the device 10. A selectively repositionable control box 22 is provided and extends generally upward and forward of the front portion 18 from the cabinet 12 and includes additional controls 16 to allow for additional control measures for an operator. It should be noted that other configurations for the controls 16 are contemplated and may be used without departing from the spirit and scope of the present invention.

Figure 2:
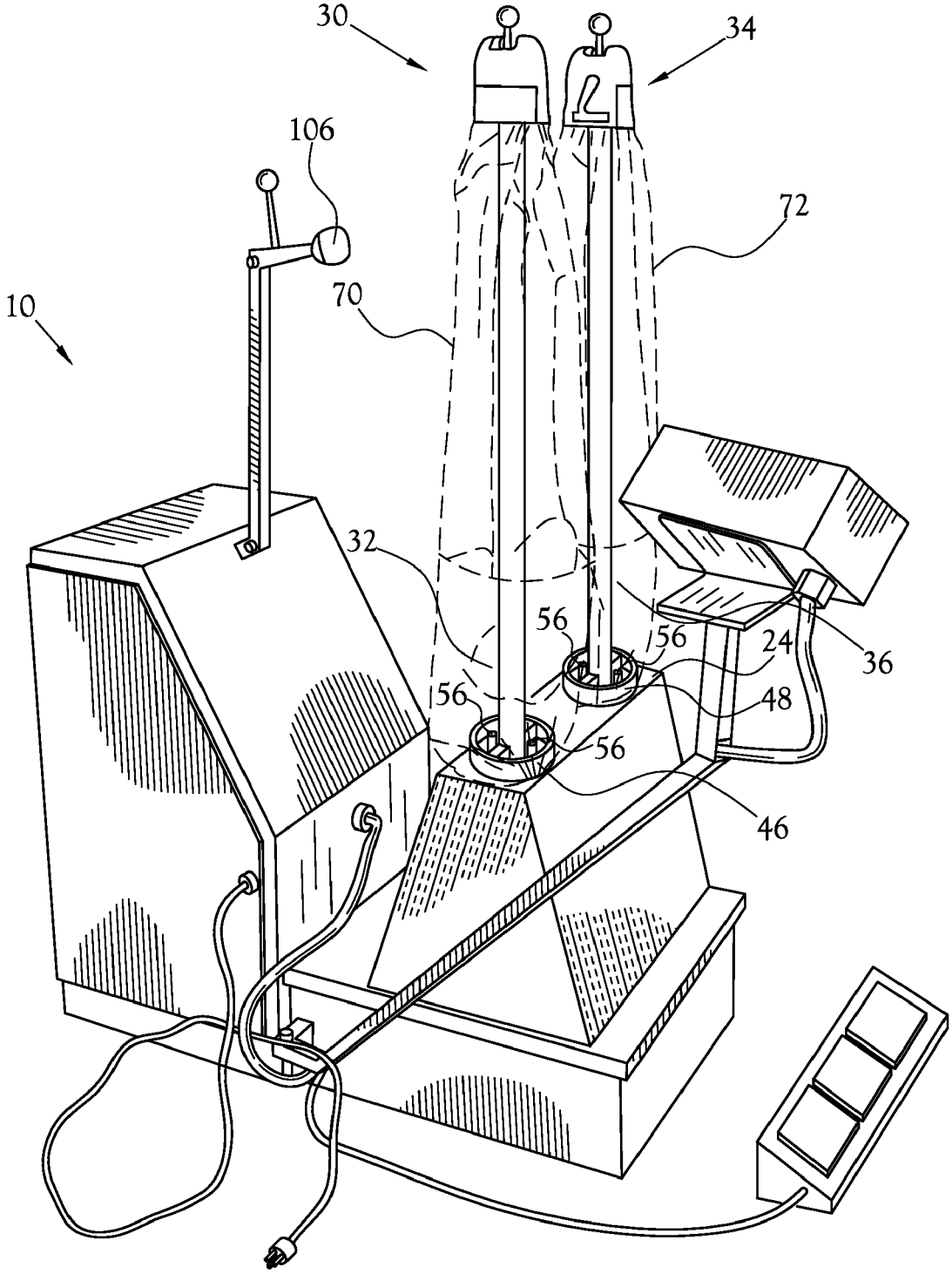
FIG. 2 is a perspective view of the device for removing wrinkles from the sleeve of a garment of FIG. 1, showing the sleeve holders within the air bags.

Referring to FIG. 2, the working surface 24 defines a first opening 46, and a second opening 48. The working surface 24 includes mounting apparatus for mounting at least one sleeve, such as the sleeves 26, 28 of a shirt (see FIG. 6), proximate the first and second openings 46, 48. It will be understood that the term "sleeve" as used herein includes tubular portions of a garment for the upper body such as a shirt, coat, sweater, and the like, and also includes tubular portions of a garment for the lower body such as pants, shorts, chaps, and the like. In the illustrated embodiment, a first sleeve holder 30 having a base end 32 and a distal end 66 is attached to the working surface 24 proximate the first opening 46 at the first sleeve holder base end 32. A second sleeve holder 34 having a base end 36 and a distal end 68 is attached to the working surface 24 proximate the second opening 48 at the second sleeve holder base end 36. Each sleeve holder 30, 34 is disposed to extend upwards from the working surface 24 in substantially parallel and spaced apart orientation.

A first elongated air bag 70 is positioned on the first sleeve holder 30, and a second elongated air bag 72 is positioned on the second sleeve holder 34. The first air bag 70 extends along the length of the first sleeve holder 30 and substantially surrounds the first sleeve holder 30 and cooperating first opening 46. Likewise, the second air bag 72 extends along the length of the second sleeve holder 34 and substantially surrounds the second sleeve holder 34 and cooperating second opening 48. Each elongated air bag 70, 72 is independently replaceable from each first and second sleeve holder 30, 34 when either air bag 70, 72 is soiled or torn from use. Referring again to FIG. 1, in several embodiments, each air bag 70, 72 includes an upper portion 42 which is permeable to moisture, air, and steam, and a lower portion 44 which is substantially impermeable to steam and air. For example, in the illustrated embodiment, each air bag upper portion 42 is composed of a single layer of fabric that is permeable to moisture, air, and steam. Each air bag lower portion 44 is composed of multiple layers of fabric, the combination of which is substantially impermeable to moisture, air, and steam. In another embodiment, the air bags 70, 72 are each composed of a material that is permeable to moisture, air, and steam. In another embodiment, the air bags 70, 72 are each composed of a material that is permeable to air and steam.

Figure 3:
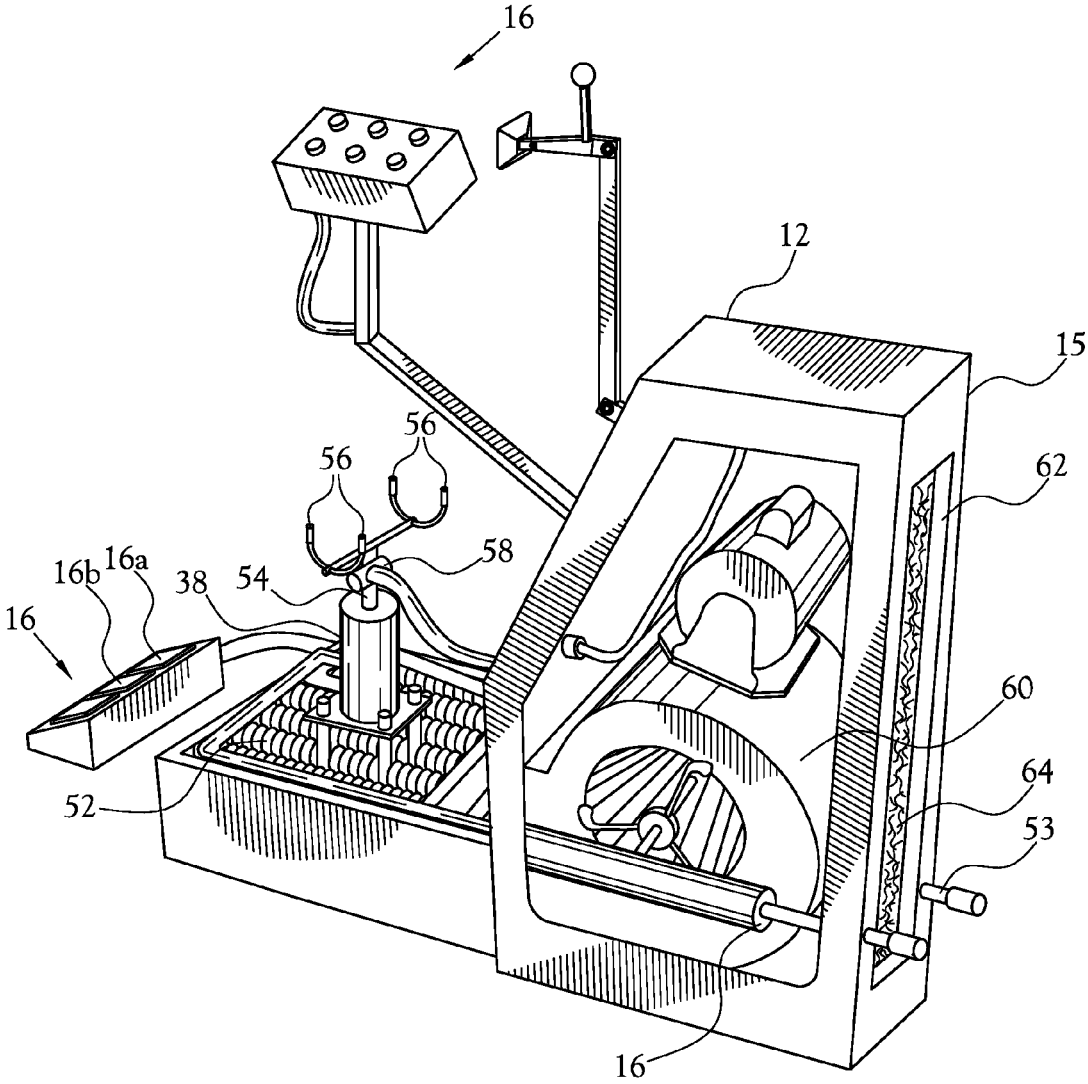
FIG. 3 is a partial perspective view showing portions of the device for removing wrinkles from the sleeve of a garment of FIG. 1 with portions of the cabinet removed.
Figure 4:
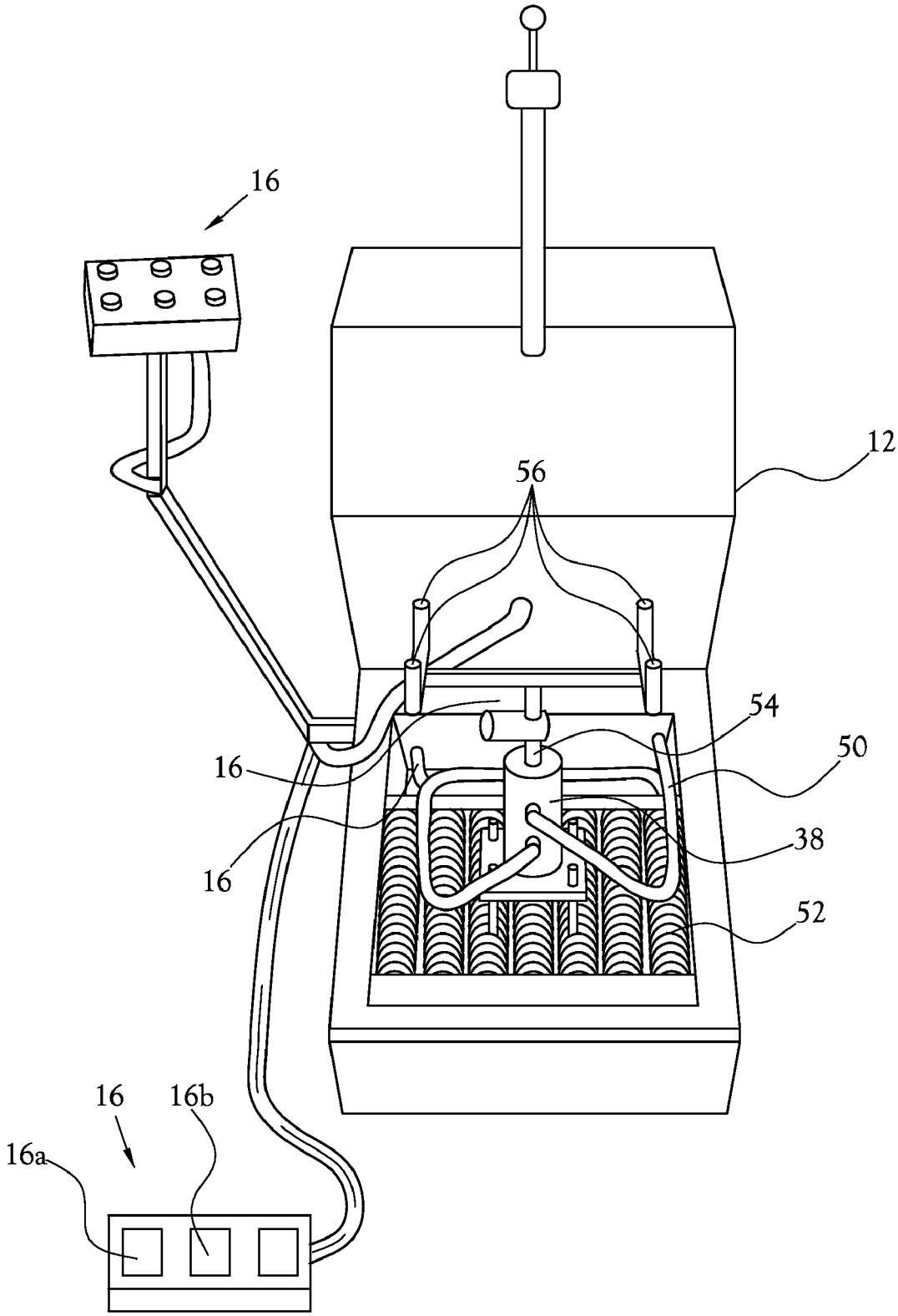
FIG. 4 is a partial perspective view showing portions of the device for removing wrinkles from the sleeve of a garment of FIG. 1.

FIGS. 3 and 4 illustrate the device 10 of FIG. 1 with the working surface 24, the sleeve holders 30, 34, and portions of the cabinet 12 removed. As shown in FIGS. 3 and 4, the cabinet 12 houses a steam reservoir 38 which is connected to a steam transfer apparatus 50 such as a steam conduit for directing steam to the interior of the steam reservoir 38. It is understood that the steam transfer apparatus 50 is adapted to be connected in fluid communication with a steam source to supply steam to the steam transfer apparatus 50. A steam coil 52 is provided in fluid communication with the steam reservoir 38 such that, as the steam reservoir 38 is filled with steam supplied by the steam transfer mechanism 50, excess steam is directed into and through the steam coil 52. The steam coil 52 includes transfer apparatus 53 for directing steam away from the steam coil 52, such as by recirculating the steam back to the steam source. While the illustrated embodiment depicts a steam transfer apparatus 50 adapted to connect to a steam source external to the device 10, those skilled in the art will recognize that a steam source such as a steam generator may be integrated into the device 10 and disposed within the cabinet 12 without departing from the spirit and scope of the present invention.

An output 54 of the steam reservoir 38 is connected to a plurality of steam outlets 56 with a valve 58 interposed therebetween. The valve 58 is operatively connected to at least one control 16 and is configured to regulate the flow of steam from the steam reservoir 38 through the steam outlets 56. The steam outlets 56 are disposed proximate the openings 46, 48 in the working surface 24 such that, by selective actuation of the valve 58, steam is selectively blown from the steam reservoir 38 through the openings 46, 48 in the working surface 24 into the air bags 70, 72.

The steam coil 52 is configured to transfer heat from steam moving within the steam coil 52 to air within the forward portion 18 of the cabinet 12 proximate the steam coil 52. An air transfer device 60 such as a blower is disposed within the cabinet 12 and is configured to move air over the steam coil 52 into the forward portion 18 of the cabinet 12, thereby heating the air, and to direct the heated air through the openings 46, 48 in the working surface 24. In the illustrated embodiment, a surface of the rear portion 15 of the cabinet 12 defines an air intake manifold 62 configured to allow air from outside the cabinet 12 to enter the cabinet 12 and be accelerated by the air transfer device 60 over the steam coil 52. In the illustrated embodiment, an air filter 64 is disposed within the air intake manifold 62 and is configured to filter at least some impurities from air entering the cabinet 12. It will be noted that those skilled in the art will recognize that the air filter 64 is not necessary to accomplish the present invention.

Referring to FIGS. 1 and 3, in operation, heated air and steam are selectively blown upwards through the openings 46, 48 defined by the working surface 24 and into each respective air bag 70, 72. Furthermore, in the illustrated embodiment, the valve 58 is in operative communication with at least a first control 16*a*, while the air transfer device 60 is in operative communication with at least a second control 16*b* to permit an operator to selectively regulate the flow of steam, heated air, or a combination thereof into and through each air bag 70, 72. In one embodiment, the controls 16 include electrical circuitry known to those skilled in the art for control of the valve 58 and air transfer device 60 for regulating flow of heated air and steam through respective openings 46, 48. In another embodiment, heated air and steam are simultaneously and continuously blown upwards through each air bag 70, 72. In still another embodiment, controls are provided to selectively direct a combination of heated air and steam upwards through each air bag 70, 72. In the illustrated embodiment, at least a portion of the forward portion 18 of the cabinet 12 is covered in a thermally-insulative material 13 to limit the loss of heat through the forward portion 18 of the cabinet 12.

As shown in FIG. 1, the upper end of each air bag 70, 72 is removably attachable to respective distal ends 66, 68 of the sleeve holders 30, 34 by a connector 74, 76 such as a clamp disposed proximate the upper end of each air bag 70, 72. Suitable connectors for attaching a sleeve of a garment proximate each air bag distal end 66, 68 is provided, such as a clamp 120, 122 provided on each air bag distal end 66, 68 having a lever 78, 80 that is adapted to be manipulated to clamp onto a sleeve end once a sleeve 26, 28 is positioned over a sleeve holder 30, 34. Alternative sleeve clamps for securing a sleeve end proximate the upper end of each air bag 70, 72 may be utilized as known to those skilled in the art.

Figure 5:
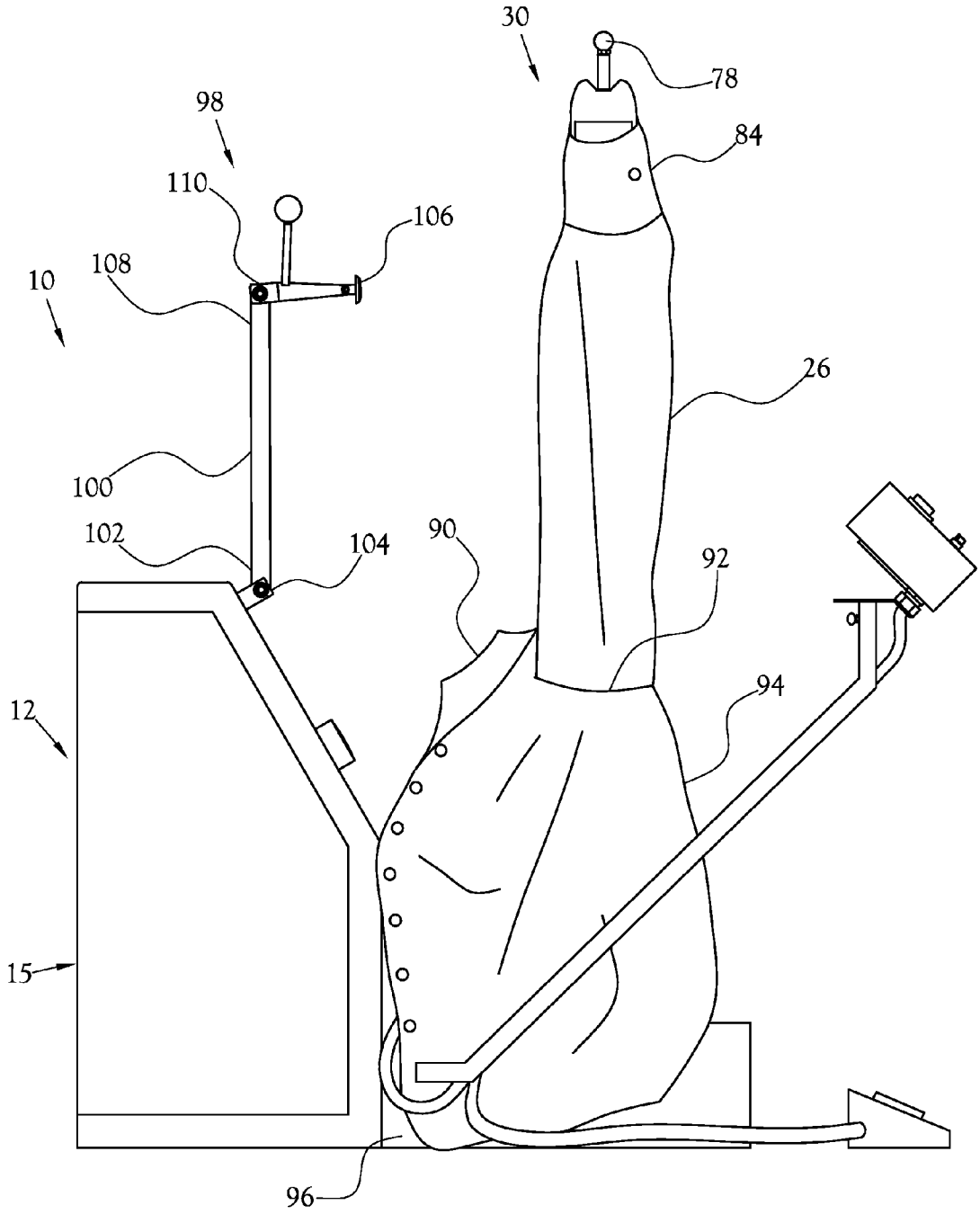
FIG. 5 is a side view of the device for removing wrinkles from the sleeve of a garment of FIG. 1, showing a shirt with sleeves positioned on the sleeve holders.
Figure 6:
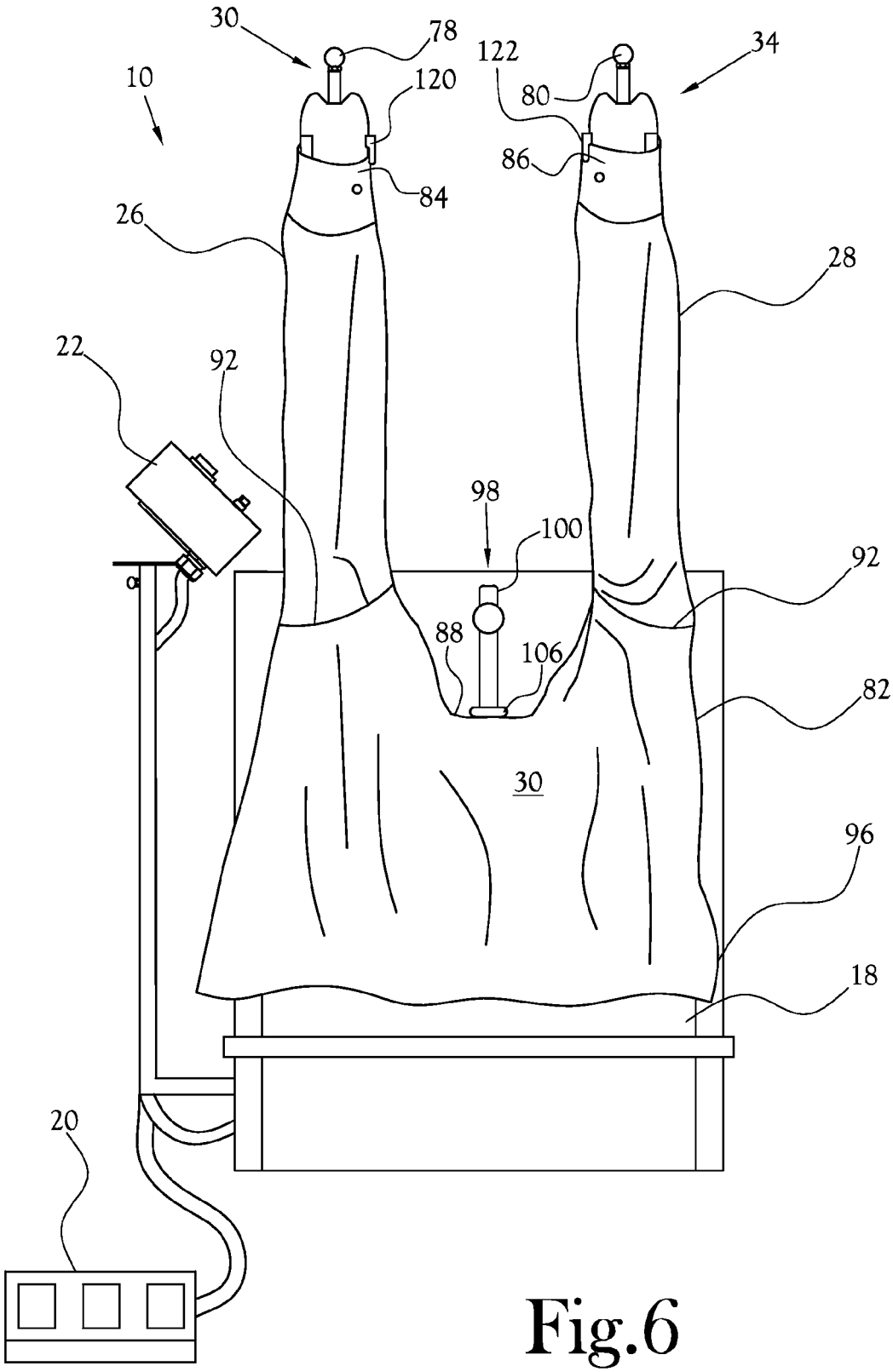
FIG. 6 is a front view of the device for removing wrinkles from the sleeve of a garment and shirt of FIG. 5.

Referring now to FIGS. 5 and 6, each sleeve holder 30, 34 is sized to accept thereon each respective sleeve 26, 28 of a garment 82. Each open sleeve end 84, 86 of each sleeve 26, 28 is clamped by the respective connectors 78, 80 to maintain each sleeve 26, 28 in an extended configuration along the length of the respective sleeve holder 30, 34. It is understood by those skilled in the art that, in a garment 82 having a pair of sleeves 26, 28, a yoke 88 portion of the garment 82 typically connects two cooperating sleeves of the garment 82. In the illustrated embodiment, the garment 82 is a shirt having a collar 90, shoulder seams 92, and a shoulder yoke 88. In this application, the collar 90, shoulder seams 92, and shoulder yoke 88 are each positioned proximate to each respective sleeve holder base end 32, 36. A back portion 94 of the shirt and a shirt tail portion 96 of the shirt remain loosely draped proximate the front portion 18 of the cabinet 12 during the operation of the device 10.

In the illustrated embodiment, a tensioning arm 98 is provided for biasing the yoke 88 portion of the garment 82 toward the working surface 24, thereby tensioning the shoulder seams 92. The tensioning arm 98 includes a substantially elongated member 100 having a proximal end 102 secured proximate the cabinet 12 by a rotatable connection 104. A contacting surface 106 is disposed proximate a distal end 108 of the elongated member 100. The rotatable connection 104 is configured to allow the elongated member 100 to rotate from a disengaged position wherein the contacting surface 106 is removed from the garment 82, toward an engaged position to allow the contacting surface 106 to engage the garment 82 and bias the yoke 88 toward the working surface 24, thereby applying tension to the yoke 88 and the shoulder seams 92.

With the yoke 88 and shoulder seams 92 held in tension by the tensioning arm 98, steam, heated air, or a combination thereof are blown upwards through the working surface 24 and into each air bag 70, 72. For example, activation of the air transfer device 60 causes heated air to be blown upwards through the working surface 24 and into each air bag 70, 72. Likewise, opening of the valve 58 causes steam to be blown upwards through the working surface 24 and into each air bag 70, 72. In this manner, each air bag 70, 72 is at least partially inflated by the steam and/or heated air within respective sleeves 26, 28 to apply tension to each sleeve 26, 28 and to hold each sleeve 26, 28 in an expanded position. As discussed above, at least an upper portion 42 of each air bag 70, 72 is permeable to steam and air. Thus, the upwardly blown steam and/or heated air is forced through the permeable portions of each air bag 70, 72, thereby applying the permeated steam and/or heated air to an inner surface of each sleeve 26, 28 through each air bag 70, 72. Thus, each sleeve 26, 28 is steamed in the expanded position, thereby removing at least a portion of the wrinkles from each sleeve 26, 28. In embodiments in which a lower portion 44 of each air bag 70, 72 is substantially impermeable to steam and air, the substantially impermeable lower portions 44 of the air bags 70, 72 serve to limit application of steam and/or heated air to portions of the interior of the garment 82 beyond the yoke 88, such as the back portion 94 and shirt tail portion 96 of the illustrated shirt. By maintaining bias of the yoke 88 toward the working surface 24 during the operation of the device 10, wrinkles are minimized along each shoulder seam 92, therefore eliminating a potential time-consuming step of a separate touch-up of residual wrinkles around the shoulder seams 92 by an operator at a pressing station. After a period of time sufficient to effectuate removal of at least a portion of the wrinkles from each sleeve 26, 28, the valve 58 is closed, thereby discontinuing the application of steam through the air bags 70, 72, and the heated air is allowed to continue to flow through the portions of the expanded air bag 70, 72 which are permeable to air to effectuate drying of each sleeve 26, 28.

In the illustrated embodiment, the rotatable connection 104 is configured such that the tensioning arm 98 rotates vertically from a raised position downward toward the working surface 24 to engage the yoke 88. In one embodiment, the weight of the tensioning arm 98 operates to bias the yoke 88 toward the working surface 24 absent additional mechanical biasing means. In another embodiment, the rotatable connection 104 defines a frictional connection configured to hold the tensioning arm 98 in the engaged position. In still another embodiment, a biasing device such as a spring (not shown) is provided to bias the tensioning arm 98 toward the working surface 24. In the illustrated embodiment, a frictional pivot connection 110 is provided along the elongated member 100 proximate the contacting surface 106 and is mechanically adjustable to allow for selective repositioning of the contacting surface 106 about the distal end 108 of the elongated member 100. In this way, the pivot connection 110 allows for selective repositioning of the contacting surface 106 proximate the working surface 24 to adjust the tensioning arm 98 to accommodate varying sizes and configurations of garments 82.

Figure 7:
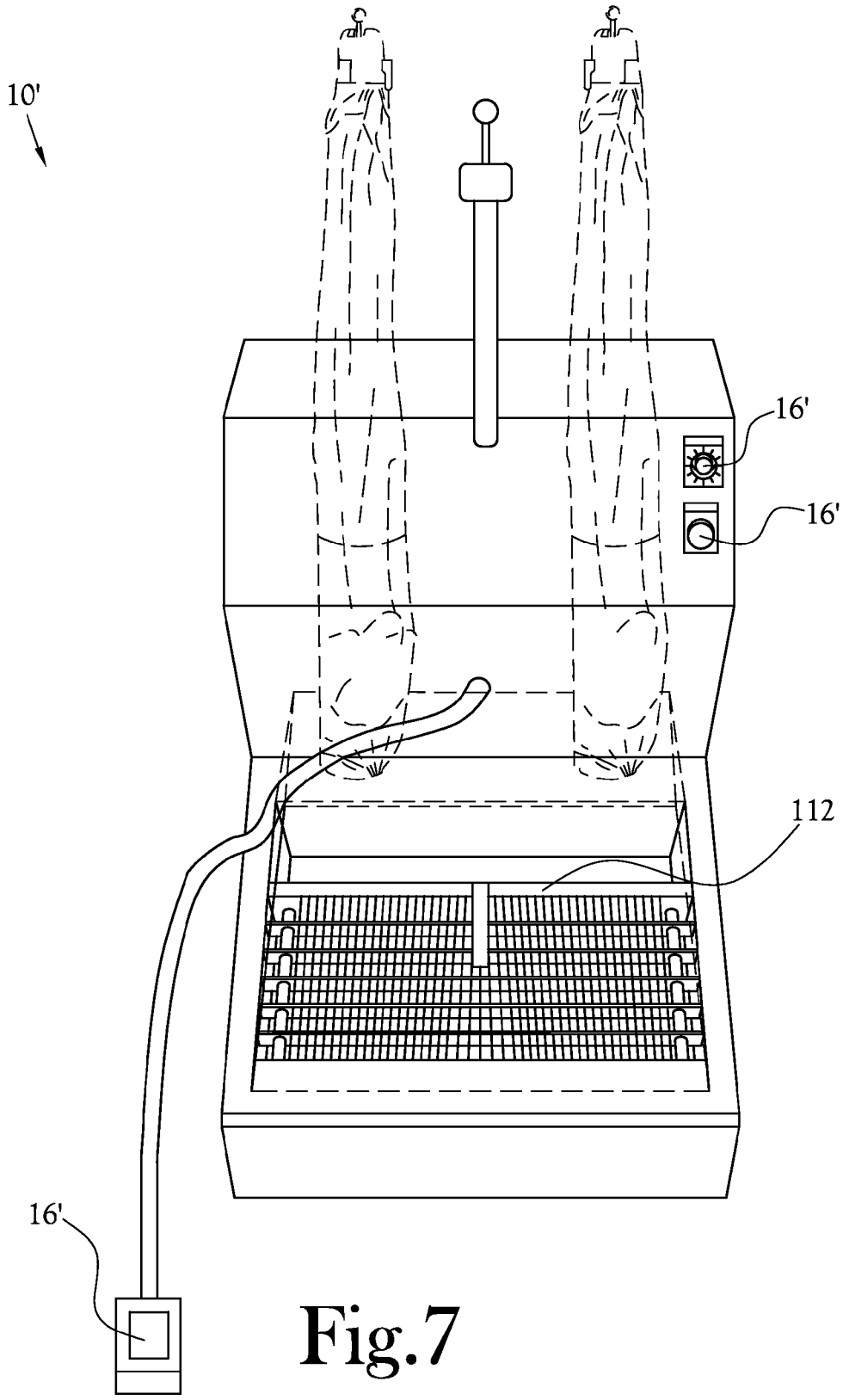
FIG. 7 is a perspective view showing another embodiment of the device for removing wrinkles from the sleeve of a garment of the present invention

FIG. 7 illustrates a partial view of an alternate embodiment of the device 10'. In the illustrated alternate embodiment, a heat transfer device 112 such as an electric heat generator is provided absent a steam coil and steam reservoir. In this embodiment, the air transfer device 60 is configured to move air through the heat transfer device 112, thereby heating the air, and to direct the heated air through the openings 46, 48 in the working surface 24 and into and through the air bags 70, 72. Suitable controls 16' are provided in communication with the air transfer device 60 and the heat transfer device 112. In this embodiment, activation of the air transfer device 60 causes heated air to be blown upwards through the working surface 24 and through the portions of the expanded air bag 70, 72 which are permeable to air, thereby applying the heated air to an inner surface of each sleeve 26, 28 through each air bag 70, 72. Thus, each sleeve 26, 28 is pressed and dried in the expanded position to remove at least a portion of the wrinkles from each sleeve 26, 28. It will be recognized that numerous types and configurations of electric heat generators suitable for use in the device 10 will be known to one of skill in the art.

A method of operation for the device 10 is disclosed including a step of providing an apparatus substantially as described hereinabove. In one embodiment, a mounting apparatus is provided including at least two sleeve holders 30, 34 supported above a working surface 24, with each sleeve holder 30, 34 having a substantially elongated, air-permeable and steam-permeable air bag 70, 72 mounted thereon, and with the sleeve holders 30, 34 sized to support the sleeves of a garment 82. In more discreet embodiments, the air bags 70, 72 each include an upper portion 42 which is permeable to moisture, air, and steam, and a lower portion 44 which is substantially impermeable to steam and air. A step of mounting includes placing a sleeve 26, 28 of a garment 82 on each of the at least two sleeve holders 30, 34 with each sleeve having a seam 92 positioned proximate the working surface. A step of tensioning includes positioning a tensioning arm 98 from a disengaged position to an engaged position toward a yoke 88 of the garment to engage and bias a yoke 88 of the garment toward the working surface 24, thereby applying tension to the yoke 88 and each seam. A step of expanding includes directing vapor into at least one air bag 70, 72 to at least partially inflate the at least one air bag 70, 72 within its respective sleeve, thereby expanding the sleeve to an expanded configuration. In several embodiments, sequential steaming and heating steps occur concurrently with the expanding step. For example, in one embodiment, a step of steaming includes directing steam into the at least one air bag 70, 72 and through the steam-permeable portions of the at least one air bag 70, 72 to apply steam to an interior surface of the respective sleeve, thereby steam conditioning the sleeve. Thereafter, a step of heating includes directing heated air into the at least one air bag 70, 72 and through the air-permeable portions of the at least one air bag 70, 72 to apply heated air to an interior surface of the respective sleeve, thereby heating and drying the sleeve. In another embodiment, the steaming and heating steps occur concurrently. The expanding step operates to condition at least one sleeve and cooperating seam of the garment to provide at least one substantially wrinkle-free sleeve 26, 28 and seam 92 for the garment without the operator having to touch-up the seam areas by a separate pressing operation, therefore eliminating a potentially time-consuming step for each seam. A step of deflating includes allowing the at least one expanded air bag 70, 72 of the expanding step to at least partially deflate. A step of retracting includes moving the tensioning arm 98 from the engaged position. Thereafter, the finished sleeve 26, 28 and seam 98 of the garment are removed from the mounting apparatus.

From the foregoing description, it will be recognized by those skilled in the art that a device for removing wrinkles from the sleeve of a garment for removing wrinkles from an article of clothing providing advantages over the prior art is provided. More specifically, the device provides an apparatus capable of accomplishing a plurality of garment finishing operations including tensioning, steaming, heating, and drying of the sleeve surfaces of a garment to produce substantially wrinkle-free sleeve and seam areas of a garment.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative device and methods, and illustrative examples shown and described. Accordingly, departures may be made from such details without departing from the spirit or scope of applicant's general inventive concept.

What is claimed is:

1. A wrinkle removal device for removing the wrinkles from a garment having a first sleeve, a second sleeve, and a yoke therebetween, said device comprising:

a working surface;

a first sleeve holder having a base end and a distal end, said first sleeve holder base end being secured proximate said working surface, said first sleeve holder being adapted to be received within the first sleeve to extend the first sleeve from said working surface;

a second sleeve holder having a base end and a distal end, said second sleeve holder base end being secured proximate said working surface, said second sleeve holder being adapted to be received within the second sleeve to extend the second sleeve from said working surface;

a first air bag removably secured to said first sleeve holder such that said first air bag is disposed within the first sleeve when said first sleeve holder is received by the first sleeve;

a second air bag removably secured to said second sleeve holder such that said second air bag is disposed within the second sleeve when said second sleeve holder is received by the second sleeve; and a steam transfer device configured to selectively transfer steam into and outwardly through each of said first and second air bags;

whereby each of said first and second air bags is permeable to steam to allow steam to enter an interior of said each air bag and pass through each air bag to apply said steam to an interior surface of a sleeve.

2. The wrinkle removal device of claim 1 wherein each of said first and second sleeve holders is adapted to be received within one of the group consisting of a shirt sleeve, a coat sleeve, a sweater sleeve, or a pant leg.

3. The wrinkle removal device of claim 1, said steam transfer device further comprising a steam reservoir adapted to be connected to a steam source, said steam reservoir being configured to selectively transfer steam to within each of said first and second air bags.

4. The wrinkle removal device of claim 1 wherein said air bags are permeable to air and steam, said device for removing wrinkles from the sleeve of a garment further including an air transfer device configured to selectively transfer air into and outwardly through each of said first and second air bags.

5. The wrinkle removal device of claim 4, further including a heat source, said air transfer device configured to selectively transfer air to said heat source to be heated, said air transfer device further configured to selectively transfer said heated air to within each of said first and second air bags.

6. The wrinkle removal device of claim 1 further including a tension member secured proximate said working surface, said tension member having a proximal end and a distal end, said proximal end being secured proximate said working surface by a rotatable connection, said tension member distal end being configured to selectively bias a yoke of a garment toward said working surface.

7. The wrinkle removal device of claim 6 further including a contact surface disposed proximate said tension member distal end, said contact surface being adapted to engage the yoke of the garment, said contact surface being repositionable proximate said tension member distal end.

8. A wrinkle removal device for removing the wrinkles from a garment having a first sleeve, a second sleeve, and a yoke therebetween, said device comprising:

a cabinet defining a substantially horizontal working surface, said working surface defining a plurality of openings;

a first mounting apparatus for mounting a first sleeve of a garment proximate at least a first of said plurality of openings to extend above said working surface;

a second mounting apparatus for mounting a second sleeve of the garment proximate at least a second of said plurality of openings to extend above said working surface;

a steam coil disposed within said cabinet;

a steam reservoir disposed within said cabinet, said steam reservoir being configured to supply steam to said steam coil to heat said steam coil, said steam reservoir being further configured to selectively direct steam upward through said openings of said working surface;

a conveyor for selectively conveying air over said steam coil to heat said air and for selectively conveying said heated air through said openings of said working surface to interior surfaces of said first and second sleeves, wherein said conveyor is an air blower;

a first air bag removably secured to said first mounting apparatus proximate said first opening such that said first air bag is disposed within the first sleeve when the first sleeve is mounted to said first mounting apparatus; and a second air bag removably secured to said second mounting apparatus proximate said second opening such that said second air bag is disposed within the second sleeve when the second sleeve is mounted to said second mounting apparatus, each of said first and second air bags having an upper portion and a lower portion, each said air bag upper portion being permeable to steam and air, each said air bag lower portion being less permeable to steam and air than each said air bag upper portion;

wherein each of said first and second air bags is permeable to steam and heated air.

9. The wrinkle removal device of claim 8 wherein said first mounting apparatus and said second mounting apparatus each comprise an elongated member having a base end secured to said working surface and a distal end extending upward from said working surface, each of said first and second distal ends being adapted to secure to a sleeve, wherein said first air bag is secured to said first elongated member distal end and substantially surrounds said first elongated member and said first opening, and wherein said second air bag is secured to said second elongated member distal end to substantially surround said second elongated member and said second opening.

10. The wrinkle removal device of claim 9 wherein said blower is configured to transfer said heated air from said steam coil through said openings to within said first and second air bags.

11. The wrinkle removal device of claim 10 wherein said steam reservoir is configured to selectively direct steam through said openings to within said first and second air bags.

12. The wrinkle removal device of claim 11 further comprising at least one controller for selectively controlling dispensation of at least one of said heated air and said steam to within said first and second air bags.

13. The wrinkle removal device of claim 8 further including a tension member secured proximate said cabinet, said tension member configured to selectively bias the yoke of the garment toward said working surface when the garment sleeves are mounted above said working surface.

14. The wrinkle removal device of claim 13, said tension member having a proximal end secured proximate said cabinet by a rotatable connection and a distal end extending from said cabinet, said device for removing wrinkles from the sleeve of a garment further comprising a contact surface secured proximate said tension member distal end, whereby said tension member is selectively rotatable about said rotatable connection between a first position and a second position to bring said contact surface in engagement with the yoke to bias the yoke toward said working surface.

15. The wrinkle removal device of claim 14 wherein said contact surface is secured to said tension member distal end by a pivotal connection, whereby said contact surface is selectively rotatable about said pivotal connection proximate said tension member distal end.

16. The wrinkle removal device of claim 14 wherein said tension member is configured to rotate vertically between said first position and said second position.

17. A wrinkle removal device for removing the wrinkles from a garment having a first sleeve, a second sleeve, and a yoke therebetween, said device comprising:

a working surface;

a first sleeve holder having a base end and a distal end, said first sleeve holder base end being secured proximate said working surface, said first sleeve holder being adapted to be received within the first sleeve to extend the first sleeve from said working surface;

a second sleeve holder having a base end and a distal end, said second sleeve holder base end being secured proximate said working surface, said second sleeve holder being adapted to be received within the second sleeve to extend the second sleeve from said working surface;

a first air bag removably secured to said first sleeve holder such that said first air bag is disposed within the first sleeve when said first sleeve holder is received by the first sleeve;

a second air bag removably secured to said second sleeve holder such that said second air bag is disposed within the second sleeve when said second sleeve holder is received by the second sleeve;

an electric air heater; and an air transfer device configured to selectively transfer air to said electric air heater to be heated, said air transfer device further configured to selectively transfer said heated air to within each of said first and second air bags; and whereby each of said first and second air bags is permeable to air to allow heated air to enter an interior of said each air bag and pass through each air bag to apply said heated air to an interior surface of a sleeve.

18. A wrinkle removal device for conditioning a garment of the type having a first tubular portion, a second tubular portion, and a yoke therebetween, said wrinkle removal device comprising:

a cabinet defining a substantially horizontal working surface having a first opening and a second opening;

a first elongated holder defining a base end and a distal end, said base end being secured to said working surface proximate said first opening, said distal end extending upwardly from said working surface, said first holder being adapted to be received within the first tubular portion to extend the first tubular portion upwardly from said working surface;

a second elongated holder defining a base end and a distal end, said base end being secured to said working surface proximate said second opening in a substantially parallel spaced configuration proximate said first holder, said distal end extending upwardly from said working surface, said second holder being adapted to be received within the second tubular portion to extend the second tubular portion upwardly from said working surface;

a first elongated air bag removably secured to said first holder distal end and configured to substantially surround said first holder and said first opening such that said first air bag is disposed within the first tubular portion when said first holder is received by the first tubular portion;

a second elongated air bag removably secured to said second holder distal end and configured to substantially surround said second holder and said second opening such that said second air bag is disposed within the second tubular portion when said second holder is received by the second tubular portion; and a steam coil disposed within said cabinet for heating air within said cabinet;

a steam reservoir disposed within said cabinet, said steam reservoir being configured to supply steam to said steam coil to heat said steam coil, said steam reservoir being further configured to selectively direct steam upward through said openings of said working surface;

a heated air transfer device disposed within said cabinet and configured to transfer heated air from said steam coil to within said first and second air bags;

at least one controller for selectively controlling dispensation of at least one of said heated air and said steam to within said first and second air bags;

a tension member secured proximate said cabinet, said tension member having a proximal end secured proximate said working surface by a rotatable connection and a distal end extending from said cabinet;

a contact surface secured proximate said tension member distal end, wherein said contact surface is secured to said tension member distal end by a pivotal connection, whereby said contact surface is selectively rotatable about said pivotal connection proximate said tension member distal end;

wherein each of said first and second elongated air bags being permeable to steam and air;

whereby said tension member is selectively rotatable about said rotatable connection between a first position and a second position to bring said contact surface in engagement with the yoke to bias the yoke toward said working surface;

whereby said steam reservoir and said heated air transfer device cooperate to at least partially inflate said first and second elongated air bags within respective tubular portions to expand the tubular portions while directing steam outwardly through said first and second elongated air bags toward interior surfaces of the tubular portions to discourage wrinkling of the tubular portions; and whereby said heated air transfer device is configured to at least partially inflate said first and second elongated air bags within respective tubular portions to expand the tubular portions while directing heated air outwardly through said first and second elongated air bags toward interior surfaces of the tubular portions to promote drying of the tubular portions.

* * * * *